United States Patent [19]

Ruffman

[11] Patent Number: 4,603,931

[45] Date of Patent: Aug. 5, 1986

[54] ANTI-THEFT DEVICE FOR APPLIANCES WITH ELECTRICAL AC POWER CORDS

[76] Inventor: Samuel H. Ruffman, 1800 Selby Ave., #2, West Los Angeles, Calif. 90025

[21] Appl. No.: 681,599

[22] Filed: Dec. 14, 1984

[51] Int. Cl.[4] ..... H01R 13/44

[52] U.S. Cl. ..... 339/37; 339/39; 339/44 M; 339/75 P; 339/82; 339/123

[58] Field of Search ..... 339/37, 39, 44 R, 44 M, 339/82, 75 P, 122, 123

[56] References Cited

U.S. PATENT DOCUMENTS

| | | | |
|---|---|---|---|
| 2,439,708 | 4/1948 | Abraham | 339/75 P |
| 2,942,226 | 6/1960 | Low | 339/75 P |
| 4,424,407 | 1/1984 | Barbic | 339/75 P |
| 4,479,688 | 10/1984 | Jennings | 339/37 |

FOREIGN PATENT DOCUMENTS 83033 4/1920 Switzerland .

*Primary Examiner*—Gil Weidenfeld
*Assistant Examiner*—Paula A. Austin
*Attorney, Agent, or Firm*—Beehler, Pavitt, Siegemund, Jagger & Martella

[57] ABSTRACT

The AC plug of an appliance is captured within an enclosure mounted to an electrical power outlet, the AC power cord of the appliance extending through restricted openings in the enclosure provided with relatively sharp edges so as to cut through the cord insulation upon attempted forced removal of the plug from the enclosure, thereby to secure the electrical appliance against theft.

17 Claims, 5 Drawing Figures

ANTI-THEFT DEVICE FOR APPLIANCES WITH ELECTRICAL AC POWER CORDS

BACKGROUND OF THE INVENTION

1. Field of the Invention

The present invention relates generally to anti-theft devices, and is more particularly directed to a device for securing an AC power plug to an electrical wall outlet to prevent unauthorized removal of the power plug and thereby deter theft of the appliance connected to the plug.

2. State of the Prior Art

Numerous devices are known for securing electrical power outlets against tampering and for preventing removal of power plugs from power outlets. The existing devices are, however, primarily safety devices intended for the protection of young children. Exemplary of such devices are U.S. Pat. Nos. 4,070,078 to Chrones, 2,526,606 to Gregg, 2,880,264 to Ruskin, and 3,467,763 to Shaw. While these devices cover any power cord plugs inserted into the electrical outlet, the protective devices are easily removed by an adult so as to permit the plugs to be readily disengaged from the electrical outlet.

Still further examples of such prior art devices are the following patents:

| Inventor | Patent Number |
|---|---|
| G. C. Monaco | 2,415,602 |
| A. J. Torcivia | 2,761,112 |
| N. L. Thaw | 3,067,402 |
| E. M. Olsen | 4,045,108 |
| R. W. Casey | 4,105,274 |
| I. S. Blonder | 3,293,588 |
| I. S. Blonder | 3,131,985 |

In spite of the numerous power outlet covers and safety devices previously known, none is designed to function in an effective theft deterent manner, and none is constructed so as to deter attempts to forcefully remove a power plug from an electrical outlet by an adult, such as by forcefully pulling on the power cord to rip the plug out of the socket and the protective cover.

SUMMARY OF THE INVENTION

The present invention overcomes these and other shortcomings of the prior art by providing an anti-theft device for securing a power plug against forced removal from an electrical power outlet, which device comprises an enclosure attachable to an electrical outlet by means requiring a tool such as a screw driver or a wrench for its detachment. The enclosure is designed to enclose and cover any electrical power plugs inserted into the outlet, but to allow passage of electrical power cords connected to the power plugs through restricted openings in the enclosure, to thus capture the power plugs within the enclosure. The enclosure is made of an electrically conductive material, e.g. metal, and the apertures through which extend the power cords have unprotected edges capable of cutting into the electrical insulation of the power cords extending therethrough in the event of attempted forced removal of the power plugs from the enclosure, so as to create an electrical short circuit between the power cord conductors, and thereby discourage any further such attempt because of the sparking and noise produced by such a high-voltage short circuit. In addition, the resulting damage to the power cord may render the target appliance less interesting to the would-be thief.

DETAILED DESCRIPTION OF THE PREFERRED EMBODIMENTS

Figures 1, 2, 3, 4, 5:
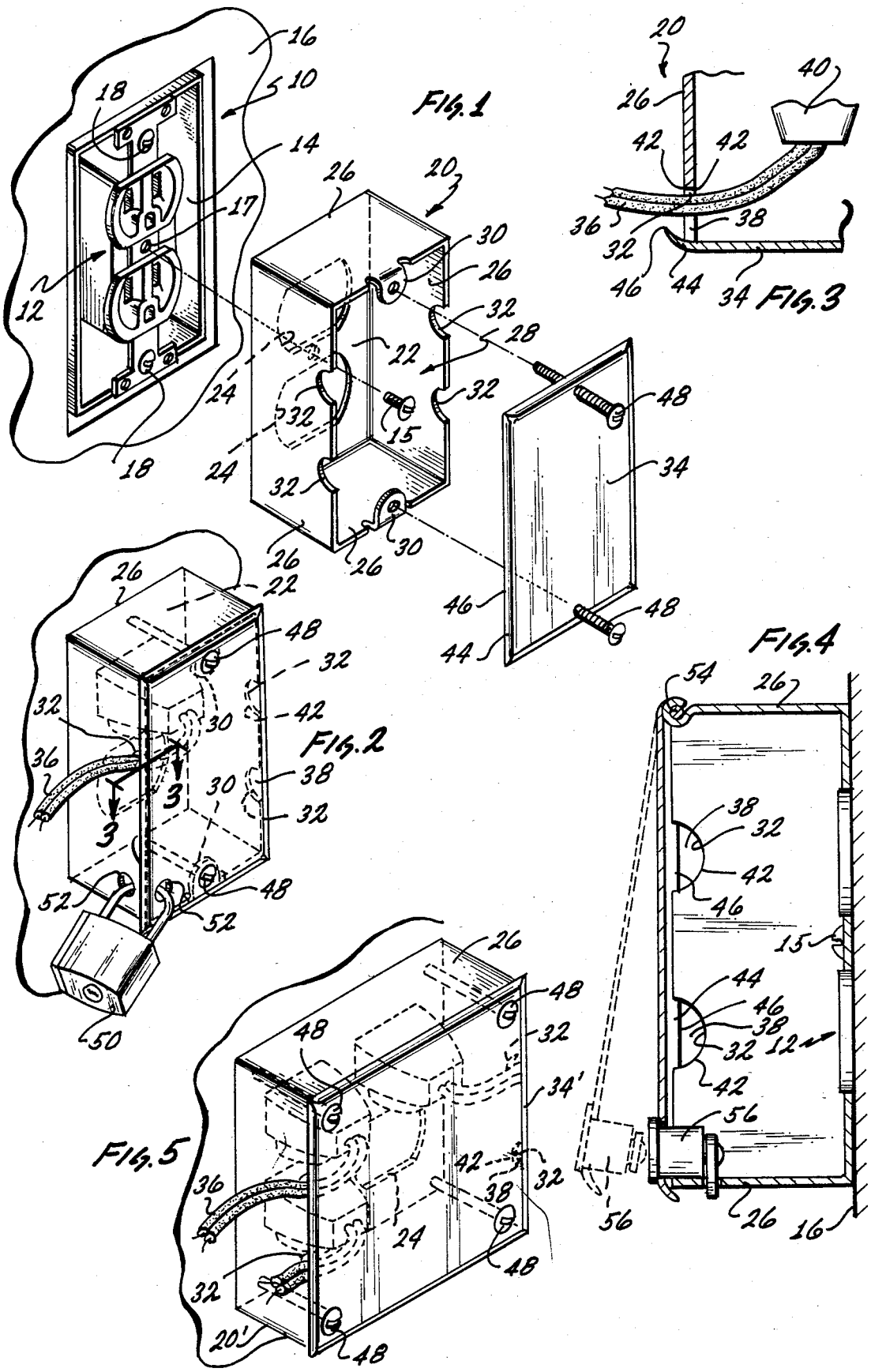
FIG. 1 is an exploded perspective view of an anti-theft device constructed according to the present invention.
FIG. 2 is a view of an anti-theft device mounted to an electrical wall outlet with a power cord secured therein.
FIG. 3 is a detail view of a power cord opening in the anti-theft device showing a power cord extending therethrough, and connected to a power plug captive within the enclosure of the anti-theft device.
FIG. 4 is a cross-sectional view taken in elevation of an alternate embodiment of the invention provided with a hinged cover.
FIG. 5 shows an anti-theft device according to this invention adapted to a quadruple socket wall outlet.

With reference to the drawings, and FIG. 1 in particular, a conventional dual socket AC wall power outlet 10 is shown, consisting of a dual receptacle unit 12 mounted within a junction box 14 in a wall 16. The female receptacle unit 12 is mounted by means of screws 18 to mounting tabs (not visible) integral to the junction box. Both the junction box and the receptacle unit 12 are standard commercially available items which need not be described further. The junction box 14 is usually a metallic box which is electrically grounded through the armored metallic electrical conduit used in such systems.

The device of this invention, in a first embodiment shown in FIGS. 1 and 2, consists of a rectangular metallic enclosure 20 which has a face plate wall 22, in which are formed two plug openings 24 through which a power plug may be inserted into either one of the receptacles of the wall outlet 10. The enclosure 20 further comprises four side walls 26 and an open side 28 opposite the face plate wall 22. The enclosure 20, which may be a commercially available metallic box provided with tabs 30, is mounted to the wall outlet by means of a screw 15 threaded into the conventional face plate screw hole 17 in the outlet 10.

The enclosure 20 is modified by forming notches 32 in the outer edges of the side walls 26. The notches, which may be semicircular, define openings 38 together with a cover plate 34 secured to close the open side 28 of the enclosure 20. Each cord opening 38 is dimensioned for allowing passage of a power cord, but is small enough to prevent a power plug 40 attached to the cord within the enclosure 20 from being withdrawn from the enclosure through the opening 38.

FIG. 3 illustrates a power cord 36 of the common, two conductor variety passing through an opening 38 defined between the side wall 26 and the cover 34 by the notch 32 formed in the side wall. A power plug 40 within the enclosure 20 cannot be withdrawn through the opening 38, due to its larger size. The dimensions of the opening 38 are not critical, and may be typically between one-quarter and one-half inch in diameter.

The enclosure 20, including side walls 26, are made of rigid metal, and the notches 32 may be formed by grinding away a semicircle of such material with any suitable tool. The resultant notch edges are squared off as best appreciatd in FIG. 3 so as to leave relatively sharp corners 42. The metallic cover 34 may also be a commercially available item of the type having bent edges 44 teminating in a relatively sharp edge 46. Thus, the power cord 36 extends between the edge 46 of the cover plate and the corner edges 42 in the side wall 26.

The cover 34 is fastened to the enclosure 20 by means of two relatively long screws 48 threaded into the tabs 30 integral with the housing 20. Typically, the screws 48 may extend nearly the full depth of the enclosure 20. The cover 34 cannot, as a practical matter, be removed without use of a tool such as a screw driver. Even with the aid of such a tool, due to the length of each screw 48, the average individual would require a few minutes to detach the plate 34 for access into the housing 20. While an individual with ample time and provided with such a tool would be able to leisurely open the housing 20 and remove the plug 40, it is not the intent of this device to protect against a determined and calculating thief. Rather, the present device is a simple, inexpensive means for protecting against the casual or less experienced thief who will be more easily deterred or will seek easier prey if faced with the obstacle created by the anti-theft device of this invention.

To further secure the closure of the box 20, a padlock 50 may be inserted through openings 52 in the cover 34 and a side wall 26 as shown in FIG. 2, so as to prevent opening of the enclosure 20 even by a more determined thief armed with suitable tooling.

The petty criminal, faced with a physical restraint, such as imposed by the enclosure 20, is likely to try and rip the cord 36 away from the plug 40, expecting that the damage to the appliance would be minor and easily repaired without greatly diminishing the value of the article. The anti-theft device of this invention is designed to prevent this by cutting through the insulation of the cord 36 with the edges 42, 46 so as to short circuit the conductors of the power cord. Such short circuit will occur whether or not the appliance connected to the power cord is turned on at the time. The AC line voltage is sufficient to create sparks, smoke and noise when such a short circuit takes place so as to scare away all but the most determined criminal. Further, such a short circuit may cause the fuses protecting the wall outlet against overload to blow or open, thus interrupting electrical power to other circuits in the building, and possibly turning off lights, etc., which is not only likely to further scare away the thief, but may also alert others in the area to the attempted theft.

Creation of a short circuit across the power cord conductors is facilitated because the power cord exits the box at a 45 degree angle to the direction of insertion of the plug into the wall socket as best appreciated in FIG. 3. Thus, the thief is likely to be pulling on the cord in a direction generally perpendicular to the wall, rubbing the insulation against the edge 46 of the plate, or generally twisting and jerking the line within the notch 32 so as to bring into action both the edges 42 and 36 defining the notch opening 38. While the effect of such a short circuit can be spectacular, the thief is not likely to be physically hurt by the short circuit since current from the wall outlet 10 will only flow through the plug up to the point of the line cord which has been cut into by the unprotected edges 42, 46 of the enclosure 20.

In those wall outlets where the face plate mounting screw 15 is grounded to the outlet box 14, the enclosure 20 and metallic cover 34 will also be grounded. This improves the performance of the anti-theft device in that under such circumstances a short circuit will be created when only one of the power cord conductors comes into contact with either the cover plate 34 or enclosure side wall 26.

FIG. 4 illustrates an alternate embodiment of the anti-theft device wherein the cover 34 is hinged along one edge at 54 for movement between a closed position shown in solid lines and an open position suggested in dotted lining. The alternate enclosure of FIG. 4 may be provided with a key operated lock 56 at the end of the cover 34 opposite the hinge 54. In other respects, the device of FIG. 4 is similar to that of FIG. 1, and includes two pairs of power cord notches 32 formed in each of the parallel vertical side walls 26.

FIG. 5 illustrates a larger version of the anti-theft device adapted for use with quadruple socket wall outlets. The enclosure 20' is larger and cover plate 34' is secured thereto by means of four screws 48, but otherwise includes all of the elements of the smaller embodiment of FIGS. 1 and 2.

While several preferred embodiments of the invention have been shown and illustrated for purposes of clarity, it will be understood that many changes, modifications and substitutions can be made by those possessed of average skill in the art. Therefore, the scope of the invention is limited only by the following claims.

What is claimed is:

1. Anti-theft device for securing a power plug against removal from an electrical power outlet comprising:

an enclosure of electrically conductive material having a face plate wall apertured to allow insertion of at least one power plug into an electrical power outlet covered by said face plate wall, a plurality of side walls, and an open side;

means for securing said face plate wall over an electrical power outlet;

a cover for closing said open side;

means for fastening said cover to said enlosure; and one or more openings defined between said cover and at least one of the side walls, each said opening being dimensioned to allow passage of an electrical power cord but to prevent passage of a power plug attached to the cord within the enclosure, each said opening being defined by unprotected relatively sharp edges so as to cut into the electrical insulation of a power cord passing through the opening upon attempted forced removal of the power plug from the enlosure and thereby create a short circuit to deter theft.

2. The device of claim 1 wherein said means for securing the face plate comprises one or more metallic screws for grounding said enclosure to the outlet when the enclosure is mounted thereto.

3. The device of claim 1 wherein said cover is also electrically conductive.

4. The device of claim 1 wherein said enclosure is a conventional electrical metallic outlet box and said cover is a metallic cover plate of standard dimensions.

5. The device of claim 1 wherein said cover plate wall is dimensioned and configured as a replacement for a conventional face plate of an electrical wall outlet.

6. The device of claim 1 wherein said cover is hinged to said enclosure for movement between an open position allowing access into said enclosure and a closed position restricting access thereinto and further comprising lock means for locking said cover in said closed position.

7. The device of claim 1 wherein each of said openings is a notch formed in the edge of said least one side wall proximate to said cover such that with the cover in place a restricted opening into said enclosure is defined.

8. The device of claim 7 wherein said cover has a relatively sharp edge extending across each said notch so as to cut into electrically insulated power cord upon attempted forced removal of the power plug from said enclosure.

9. The device of claim 1 wherein said means for fastening said cover to said enclosure comprises one or more screws.

10. The device of claim 9 wherein said one or more screws are metallic screws.

11. Anti-theft device for securing a power plug against removal from an electrical power outlet comprising:

a rectangular box having one wall dimensioned for mounting as a face plate for an electrical wall outlet and apertured to allow insertion of one or more power plugs into such an outlet, said box further having four side walls and an open side opposite said face plate wall;

means for securing said face plate wall to an electrical outlet;

a cover for closing said open side;

means for fastening said cover ot said box; and one or more notches formed in said side walls each defining with said cover an opening dimensioned to allow passage of an electrical power cord therethrough but to prevent removal of a power plug attached to said cord within said box, said opening having unprotected relatively sharp edges so as to cut into the insulation of electrical power cord passing through the opening upon attempted forced removal of the power plug from the box and thereby create a short circuit as a deterrent to theft of the appliance connected to the power cord.

12. The device of claim 11 wherein said box is metallic and said means for securing include at least one screw threadable into the wall outlet.

13. The device of claim 11 wherein said means for securing also include means for electrically grounding said enclosure to said outlet so as to create a short circuit upon making electrical contact between said box and only one of the power cord conductors.

14. The device of claim 11 further comprising cover means detachable for allowing access into said enclosure for removing power plugs thereform.

15. Anti-theft device for securing a power plug against removal form an electrical power outlet comprising:

an enclosure attachable to an electrical outlet so as to enclose any electrical power plugs inserted into said outlet, said enclosure being apertured to allow passage of electrical power cords connected to the power plugs but retaining the plugs captive in said enclosure, said apertures in the enclosure having unprotected edges so as cut into the electrical insulation of the power cords in the event of attempted forced removal of the power plugs from said enclosure, said enclosure being of electrically conductive material so as to create a short circuit between the power cord conductors.

16. Anti-theft device for securing a power plug against removal from an electrical power outlet comprising:

a box having one wall dimensioned for mounting as a face plate for an electrical wall outlet and apertured to allow insertion of one or more power plugs into such an outlet, said box further having a plurality of walls and an open side opposite said face plate wall;

means for securing said face plate wall to an electrical outlet;

a cover for closing said open side;

mean for fastening said cover to said box; and one or more notches defined between said side walls and said cover each said notch defining an opening dimensioned to allow passage of an electrical power cord therethrough but preventing removal of a power plug attached to said cord within said box, said opening having unprotected relatively sharp edges so as to cut into the insulation of an electrical power cord passing through the opening upon attempted forced removal of the power plug from the box as deterrent to theft of the appliance connected to the power cord.

17. Anti-theft device for securing a power plug against removal from an electrical power outlet comprising:

a box having one wall dimensioned for mounting as a face plate for an electrical wall outlet and apertured to allow insertion of one or more power plugs into such an outlet, said box further having a plurality of walls and an open side opposite said face plate wall;

means for securing said face plate wall to an electrical outlet;

a cover for closing said open side;

mean for fastening said cover to said box; and one or more notches defined between said side walls and said cover each said notch defining an opening dimensioned to allow passage of an electrical power cord therethrough but preventing removal of a power plug attached to said cord within said box.

* * * * *